US009383107B2

(12) United States Patent
Shershnyov et al.

(10) Patent No.: US 9,383,107 B2
(45) Date of Patent: Jul. 5, 2016

(54) DUAL FUEL NOZZLE TIP ASSEMBLY WITH IMPINGEMENT COOLED NOZZLE TIP

(71) Applicant: General Electric Company, Schenectady, NY (US)

(72) Inventors: Borys Borysovych Shershnyov, Moscow (RU); Leonid Yulyevich Ginessin, Moscow (RU)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 291 days.

(21) Appl. No.: 14/077,557

(22) Filed: Nov. 12, 2013

(65) Prior Publication Data

US 2014/0190168 A1 Jul. 10, 2014

(30) Foreign Application Priority Data

Jan. 10, 2013 (RU) ..... 2013102451

(51) Int. Cl.

| | |
|---|---|
| ***F23R 3/28*** | (2006.01) |
| ***F23R 3/14*** | (2006.01) |
| ***F23R 3/36*** | (2006.01) |

(52) U.S. Cl.

CPC . *F23R 3/283* (2013.01); *F23R 3/14* (2013.01); *F23R 3/286* (2013.01); *F23R 3/36* (2013.01); *F23R 2900/03044* (2013.01)

(58) Field of Classification Search

CPC ..... F23R 3/14; F23R 3/283; F23R 3/286; F23R 3/36; F23D 11/002; F23D 17/002

See application file for complete search history.

(56) References Cited

U.S. PATENT DOCUMENTS

| | | | | |
|---|---|---|---|---|
| 5,833,141 | A | 11/1998 | Bechtel, II et al. | |
| 6,123,273 | A | 9/2000 | Loprinzo et al. | |
| 6,438,961 | B2 | 8/2002 | Tuthill et al. | |
| 6,698,207 | B1 | 3/2004 | Wiebe et al. | |
| 6,715,292 | B1 | 4/2004 | Hoke | |
| 7,412,833 | B2 | 8/2008 | Widener | |
| 7,540,154 | B2 | 6/2009 | Tanimura et al. | |
| 7,861,528 | B2 | 1/2011 | Myers et al. | |
| 8,079,218 | B2 | 12/2011 | Widener | |
| 8,099,940 | B2 | 1/2012 | Twardochleb et al. | |
| 8,161,750 | B2 | 4/2012 | Simmons et al. | |
| 8,166,763 | B2 | 5/2012 | Piper et al. | |
| 2005/0016178 | A1* | 1/2005 | Wasif | F23R 3/14 60/752 |
| 2007/0169486 | A1* | 7/2007 | Hernandez | F23R 3/286 60/776 |
| 2007/0277530 | A1 | 12/2007 | Dinu et al. | |
| 2009/0050710 | A1 | 2/2009 | Myers et al. | |
| 2012/0125008 | A1* | 5/2012 | Prociw | F23R 3/346 60/776 |

* cited by examiner

*Primary Examiner* — Phutthiwat Wongwian
*Assistant Examiner* — Marc Amar
(74) *Attorney, Agent, or Firm* — Dority & Manning, PA

(57) ABSTRACT

A fuel nozzle for a combustor includes a burner tube and a center nozzle assembly disposed within the burner tube. The center nozzle assembly includes a center body that at least partially defines a cooling air flow passage through the center nozzle assembly. A premix flow passage is defined between the burner tube and the center nozzle assembly. A tip assembly is disposed at a downstream end of the center body. The tip assembly includes an impingement plate, and a cap that is disposed downstream from the impingement plate. The impingement plate and the cap at least partially define a cooling plenum therebetween. An insert passage extends through the impingement plate and a cooling flow outlet extends through the cap. A plurality of cooling ports extends through the impingement plate to provide for fluid communication between the cooling air flow passage and the cooling plenum.

18 Claims, 6 Drawing Sheets

DUAL FUEL NOZZLE TIP ASSEMBLY WITH IMPINGEMENT COOLED NOZZLE TIP

FIELD OF THE INVENTION

The present invention generally involves a fuel nozzle for a combustor. More specifically, the invention relates to a center body tip assembly for a dual-fuel fuel nozzle for a combustor of a gas turbine.

BACKGROUND OF THE INVENTION

In a gas turbine, fuel nozzles are used to mix a compressed working fluid such as air with a fuel for combustion within a combustion zone that is positioned downstream from the fuel nozzles. Some fuel nozzles are configured to operate on one type of fuel such as a gas fuel during gas fuel operation mode and on a second type of fuel such as a liquid fuel during liquid fuel operation mode. Where a liquid fuel is used for diffusion mode operation, coking forms and high thermal stresses occur at a central body tip portion of the fuel nozzle.

A particular fuel nozzle configuration that is capable of both gas and liquid mode operation generally includes an outer premix flow passage that is at least partially defined by a burner tube and a plurality of swirler vanes that extend radially inward from the burner tube into the premix flow path. The fuel nozzle further includes a central body that is coaxially aligned with the burner tube and that extends at least partially through the burner tube. The central body defines a recirculation zone for flame stabilization in a central area of a combustion zone that is downstream from the fuel nozzle. A liquid fuel cartridge (LFC) extends at least partially through the central body and/or the burner tube and/or the premix flow passage. The LFC being coaxially aligned with the burner tube. A LFC tip assembly is at least partially disposed within the center body. The LFC tip assembly includes a liquid fuel injector that is disposed at a downstream end of the center body and generally adjacent to an outlet of the premix flow passage. The liquid fuel injector tip is generally adjacent to the combustion zone of the combustor.

The LFC tip and/or the LFC tip assembly provide a mechanism for generating a flame using a liquid fuel during startup and operation of the combustor. However, because of the proximity of the LFC tip with respect to the combustion zone of the combustor, heat from the combustion gases and/or heat due to heating during premix mode operation may damage the center body tip over time. In addition, in certain configurations where the fuel nozzle is configured to flow both the gas fuel and the liquid fuel, the liquid fuel causes coke deposit formation or coking on a heated downstream surfaces of the center body tip. Current designs use a curtain of air that is routed through the center body to cool the center body tip. However, despite the general effectiveness of this system and/or method for cooling the nozzle tip, center body tips are still a life limiting component of this type of fuel nozzle. Therefore, a center body tip assembly with an improved system and/or method for cooling the center body tip would be useful in the industry.

BRIEF DESCRIPTION OF THE INVENTION

Aspects and advantages of the invention are set forth below in the following description, or may be obvious from the description, or may be learned through practice of the invention.

One embodiment of the present invention is a fuel nozzle for a combustor. The fuel nozzle includes a burner tube component and a center nozzle assembly concentrically disposed within the burner tube component. The center nozzle assembly includes a center body that at least partially defines a cooling air flow passage through the center nozzle assembly. The center body further includes a downstream end. A premix flow passage is defined between the burner tube component and the center nozzle assembly. A central recirculation zone for premix flame stabilization is defined in the area of combustion zone downstream from the center body. A tip assembly is disposed at the downstream end of the center body. The tip assembly includes an impingement plate that extends radially across the downstream end of the center body, and a radially extending cap that is disposed downstream from the impingement plate. The impingement plate and the cap at least partially define a cooling plenum therebetween. An insert passage extends through the impingement plate. A cooling flow outlet extends through the cap. The cooling flow outlet is coaxially aligned with the insert passage. A plurality of cooling ports extends through the impingement plate to provide for fluid communication between the cooling air flow passage and the cooling plenum.

Another embodiment of the present invention is a tip assembly for a fuel nozzle. The tip assembly includes an annular impingement plate that at least partially defines an insert passage that extends concentrically through the impingement plate along a longitudinal axis of the diffusion tip assembly. An annular cap is disposed coaxially downstream from the impingement plate. The cap at least partially defines a cooling flow outlet that is aligned with the insert passage. The cap includes an outer portion that extends between the impingement plate and the cap. The outer portion, the cap and the impingement plate at least partially define a cooling plenum therebetween. A plurality of angled cooling ports extends through the impingement plate to provide fluid communication into the cooling plenum. The plurality of cooling ports being set at an angle with respect to the longitudinal axis of the impingement plate within a plane defined between the longitudinal axis and a tangential axis of the impingement plate.

The present invention may also include a gas turbine having a compressor section at an upstream end of the gas turbine, a combustion section positioned downstream from the compressor section, and a turbine section positioned downstream from the combustion section. The combustion section includes a combustor that is in fluid communication with a fuel supply and a compressed air supply. The combustor has an end cover coupled to a casing that at least partially surrounds the combustor. A fuel nozzle extends downstream from the end cover. The fuel nozzle includes a burner tube component and a center nozzle assembly concentrically disposed within the burner tube component. The center nozzle assembly has an annular center body that at least partially defines a cooling air flow passage through the center nozzle assembly. The center body includes a downstream end. A premix flow passage is defined between the burner tube component and the center body assembly. A central recirculation zone for premix flame stabilization is defined in the area of combustion zone downstream from the center body. A Liquid fuel cartridge for dual fuel capability is located inside the center body. A tip assembly is disposed at the downstream end of the center body. The tip assembly has an impingement plate that extends radially across the downstream end of the center body and a radially extending cap that is disposed coaxially downstream from the impingement plate. The impingement plate and the cap at least partially define a cooling plenum therebetween. The cap and the impingement plate at least partially define an insert passage that extends through the tip assembly. A plurality of cooling ports extends through the impingement plate to provide for fluid communication between the cooling air flow passage and the cooling plenum.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
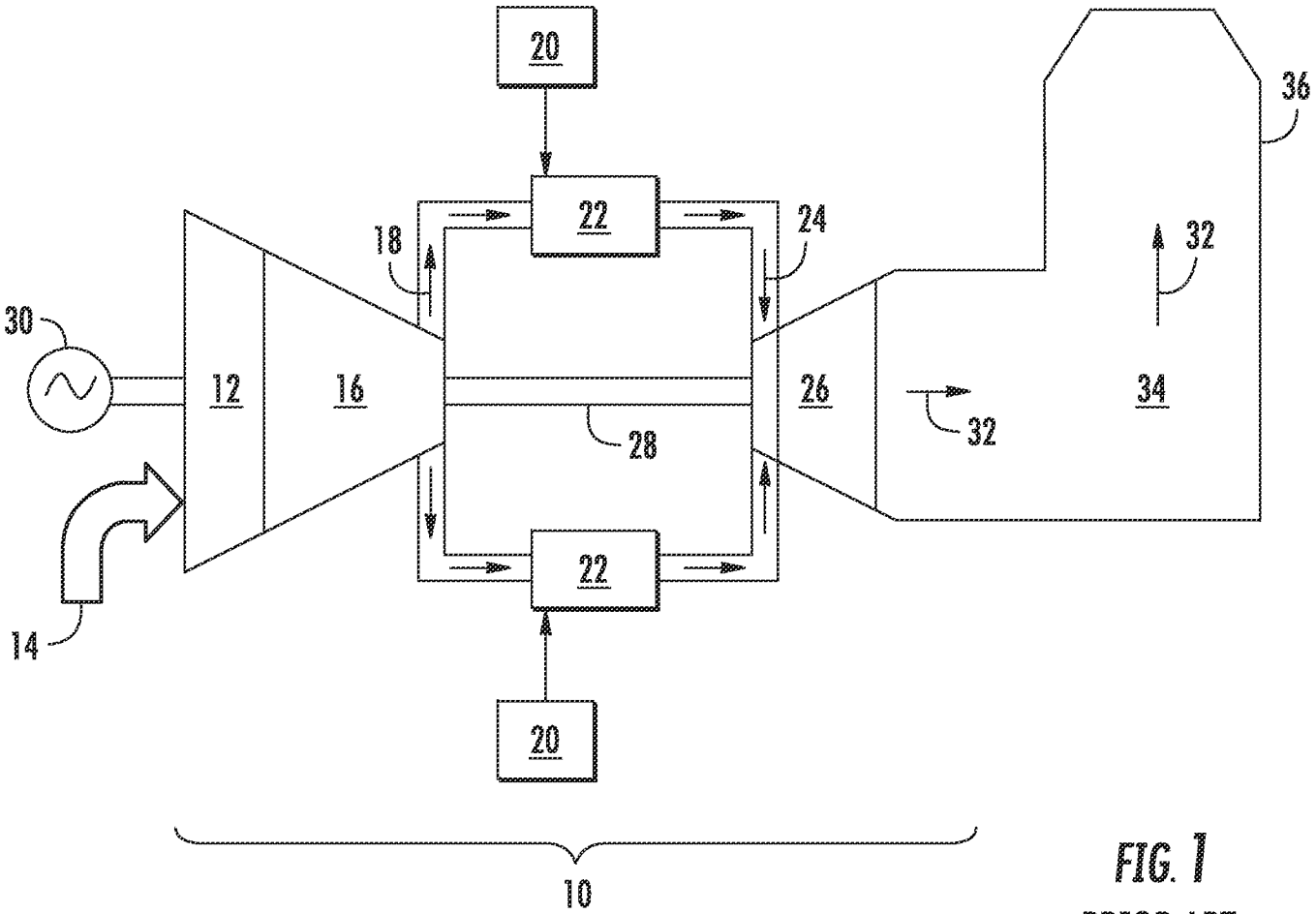
FIG. 1 PRIOR ART
FIG. 1 is a functional block diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream," "downstream," "radially," and "axially" refer to the relative direction with respect to fluid flow in a fluid pathway. For example, "upstream" refers to the direction from which the fluid flows, and "downstream" refers to the direction to which the fluid flows. Similarly, "radially" refers to the relative direction substantially perpendicular to the fluid flow, and "axially" refers to the relative direction substantially parallel to the fluid flow.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a fuel nozzle for a combustor incorporated into a gas turbine for purposes of illustration, one of ordinary skill in the art will readily appreciate that embodiments of the present invention may be applied to any combustor incorporated into any turbomachine and is not limited to a gas turbine combustor unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18 at a highly energized state.

The compressed working fluid 18 is mixed with a fuel from a fuel supply 20 to form a combustible mixture within one or more combustors 22. The combustible mixture is burned to produce combustion gases 24 having a high temperature and pressure. The combustion gases 24 flow through a turbine 26 of a turbine section to produce work. For example, the turbine 26 may be connected to a shaft 28 so that rotation of the turbine 26 drives the compressor 16 to produce the compressed working fluid 18. Alternately or in addition, the shaft 28 may connect the turbine 26 to a generator 30 for producing electricity. Exhaust gases 32 from the turbine 26 flow through an exhaust section 34 that connects the turbine 26 to an exhaust stack 36 downstream from the turbine 26. The exhaust section 34 may include, for example, a heat recovery steam generator (not shown) for cleaning and extracting additional heat from the exhaust gases 32 prior to release to the environment.

Figure 2:
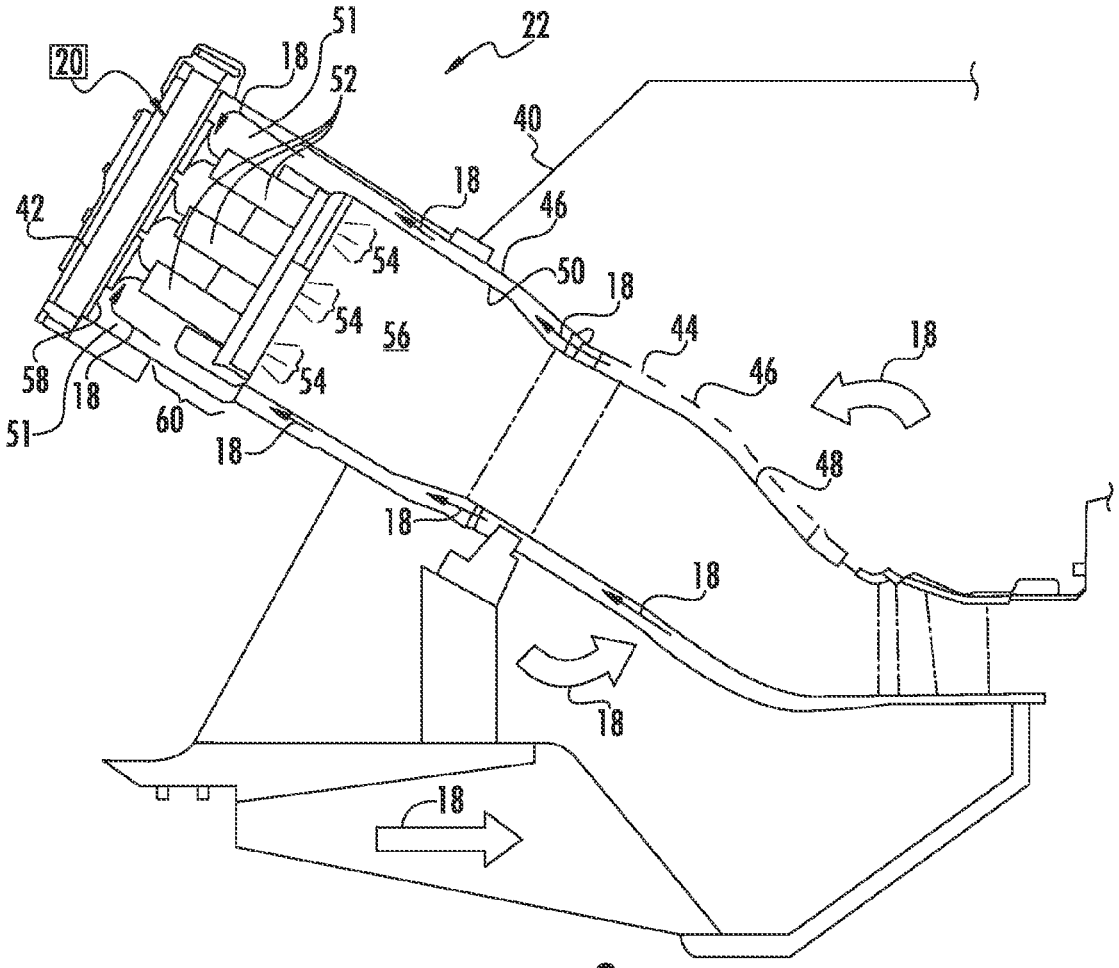
FIG. 2 is a simplified side cross-section view of an exemplary combustor according to various embodiments of the present invention.

The combustors 22 may be any type of combustor known in the art, and the present invention is not limited to any particular combustor design unless specifically recited in the claims. FIG. 2 provides a simplified cross-section side view of an exemplary combustor 22 that incorporates various embodiments of the present invention. As shown in FIG. 2, a casing 40 and an end cover 42 combine to contain the compressed working fluid 18 flowing to the combustor 22 from the compressor 16 (FIG. 1). The compressed working fluid 18 may pass through flow holes 44 in an annular flow sleeve 46 such as an impingement sleeve or a combustion flow sleeve to flow along the outside of a transition duct 48 and/or a liner 50 towards a head end 51 of the combustor 22.

The head end 51 is at least partially defined by the end cover 42 and/or the casing 40. The compressed working fluid provides convective cooling to the transition duct 48 and/or to the liner 50. At the head end 51, the compressed working fluid 18 reverses in direction and flows through a plurality of fuel nozzles 52. The fuel flows from the fuel supply system 20 through one or more fuel circuits (not shown) defined within the end cover 42 and into each or some of the fuel nozzles 52. The fuel supply system 20 may be configured to provide a gaseous and/or a liquid fuel to the combustor 22. The compressed working fluid 18 is mixed with the fuel as it passes through each of the plurality of fuel nozzles 52 to form the combustible mixture 54. The combustible mixture 54 flows from each of the fuel nozzles 52 and into a combustion chamber 56 that is defined within the combustor 22 downstream from the fuel nozzles 52 for combustion. Each of the fuel nozzles 52 extends downstream from an inner surface 58 of the end cover 42. In particular embodiments, each of the plurality of fuel nozzles 52 extends at least partially through a cap assembly 60 that extends radially and circumferentially within the combustor 22.

Figure 3:
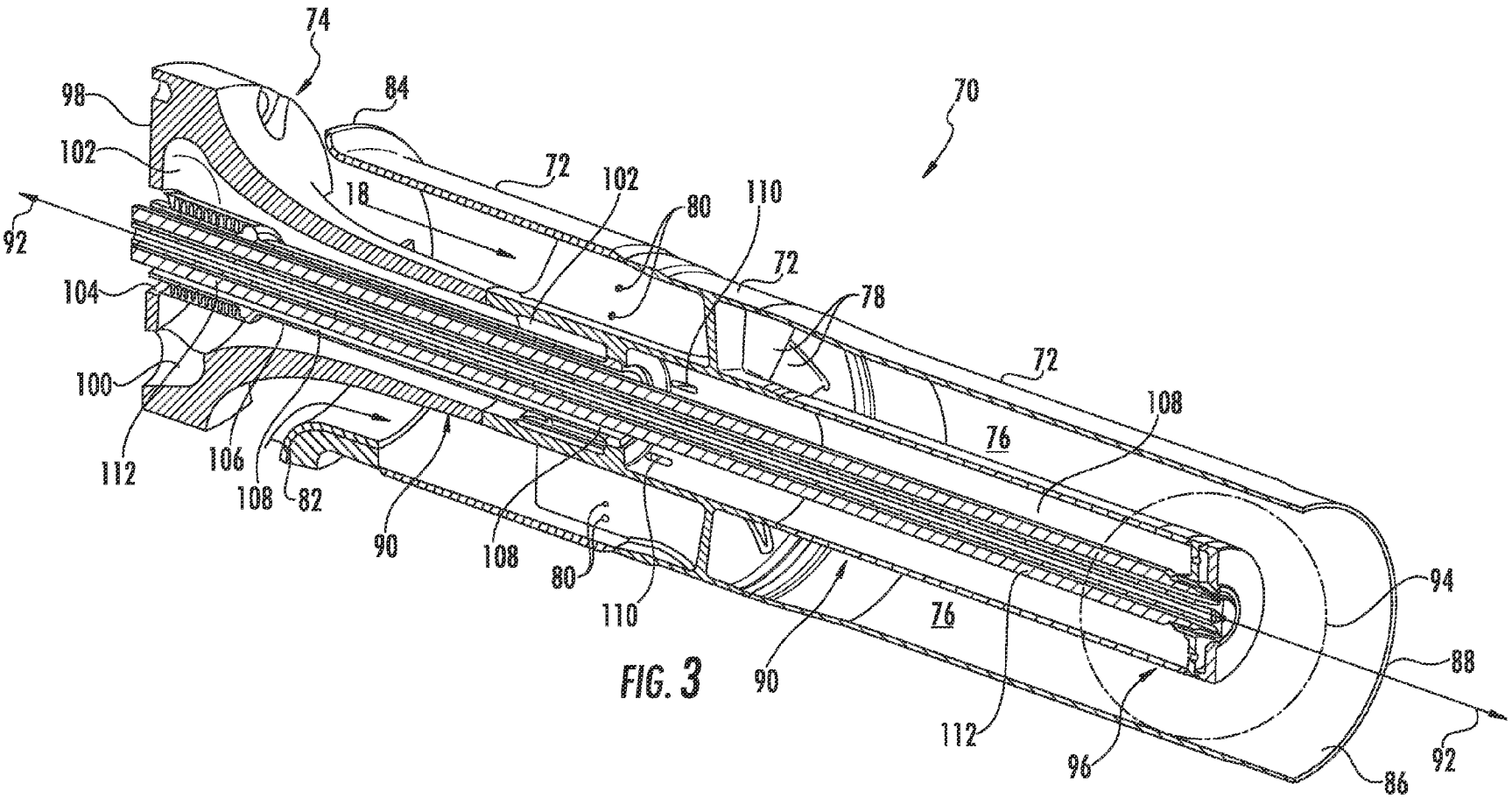
FIG. 3 provides a cross-section perspective view of a dual fuel nozzle according to various embodiments of the present disclosure.

FIG. 3 provides a cross-section perspective view of one dual fuel nozzle 70 of the plurality of fuel nozzles 52 as shown in FIG. 2, according to at least one embodiment of the present disclosure. As shown in FIG. 3, the dual fuel nozzle 70 generally includes an annular burner tube or outer shroud 72, a center nozzle assembly 74 that is positioned concentrically within the burner tube 72, and a premix flow passage 76 that is at least partially defined between the burner tube 72 and the center nozzle assembly 74. In addition, the dual fuel nozzle 70 may include a plurality of swirler vanes 78 that extend radially between the burner tube 72 and the center nozzle assembly 74 to at least partially define the premix flow passage 76.

In one embodiment, as shown in FIG. 2, the swirler vanes 78 are oriented at a swirl angle within the premix flow passage 76 to impart swirl around a portion of the center nozzle assembly 74 to the compressed working fluid 18 as it flows through the premix passage 76 towards the combustion chamber 56 (FIG. 2) of the combustor 22 (FIG. 2). In particular embodiments, each or some of the plurality of swirler vanes 78 includes one or more fuel injection ports 80 that are in fluid communication with the premix flow passage 76. An inlet 82 to the premix flow passage 76 is at least partially defined at or adjacent to an upstream end 84 of the burner tube 72. The inlet 82 is positioned generally upstream from the plurality of swirler vanes 78. An outlet 86 from the premix flow passage 76 is at least partially defined at or adjacent to a downstream end 88 of the burner tube 72. The outlet 86 is positioned downstream from the plurality of swirler vanes 78. The burner tube 72 may be manufactured as a singular component or may comprise of multiple shrouds coupled together to form the burner tube 72.

As shown in FIG. 3 the center nozzle assembly 74 generally includes an annular center body 90 that extends along a longitudinal axis 92 of the fuel nozzle 70, and a tip assembly 94 that is disposed at a downstream end 96 of the center body 90. The center body 90 includes an upstream end 98 that may be configured to mount to the end cover 42 (FIG. 2). For example, the center body 90 may at least partially define a gas fuel inlet 100 that extends through the upstream end 98. The gas fuel inlet 100 being in fluid communication with the end cover 42 (FIG. 2) and/or the fuel supply 20 (FIG. 1). In addition, the center body 90 at least partially defines a gas fuel plenum 102. The gas fuel plenum 102 being in fluid communication with the gas fuel inlet 100 and the fuel injection ports 80 of the plurality of swirler vanes 78.

In particular embodiments, as shown in FIG. 3, an opening 104 extends through the upstream end 98 of the center body 90. An annular inner sleeve 106 circumferentially surrounds the opening 104 and extends at least partially through the center body 90 to further define the gas fuel plenum 102. The inner sleeve 106 at least partially defines a cooling flow passage 108 within the center body 90 that extends from the upstream end 98 of the center body 90 to the tip assembly 94 at the downstream end 96 of the center body 90. The cooling flow passage 108 is in fluid communication with at least one of the end cover 42 (FIG. 2), a cooling medium supply (not shown) or the head end 51. In particular embodiments, one or more cooling holes 110 extend through the center body 90 and/or through the swirler vanes 78 to provide for fluid communication between the head end 51 and the cooling flow passage to route a cooling medium such as the compressed air 18 into the cooling flow passage to cool the tip assembly 94 and/or the center body 90.

Figure 4:
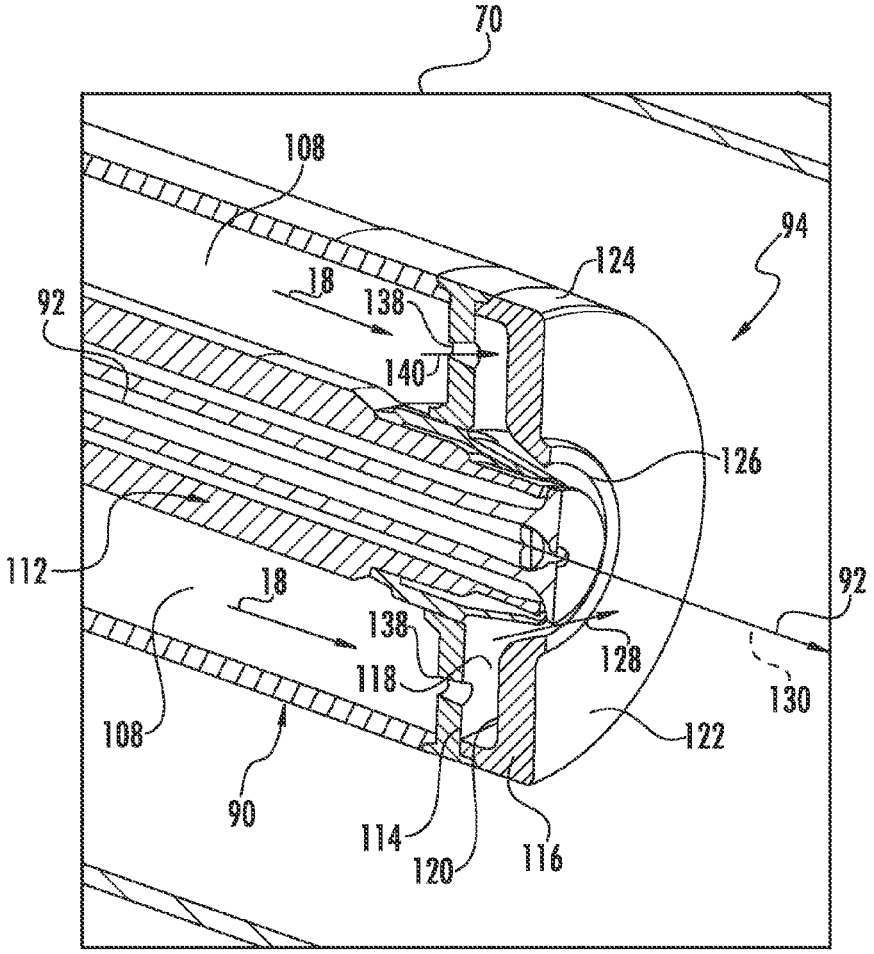
FIG. 4 provides an enlarged perspective view of a portion of the dual fuel nozzle as shown in FIG. 3.
Figure 5:
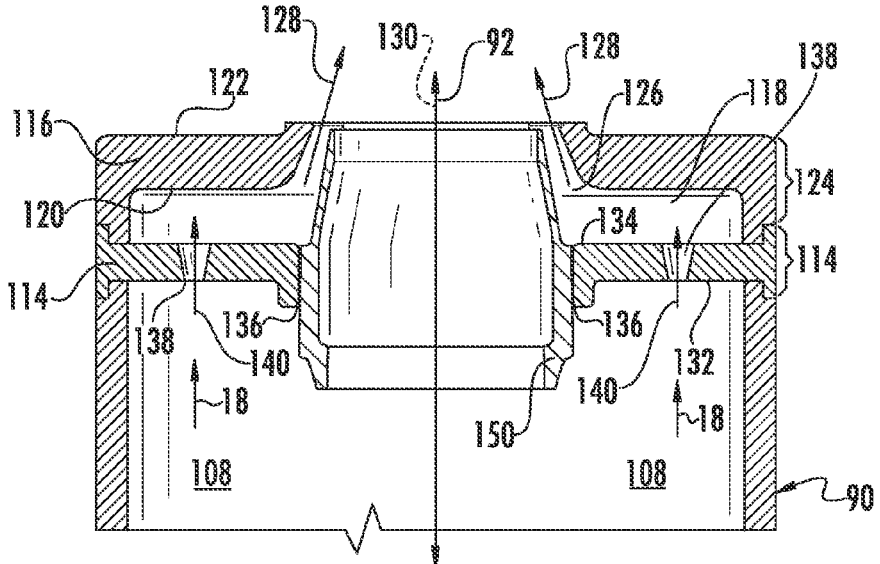
FIG. 5 provides an enlarged cross-section side view of a center body tip assembly as shown in FIG. 4, according to at least one embodiment.

FIG. 4 provides an enlarged perspective view of the tip assembly 94 including a liquid fuel cartridge 112, herein referred to as the "LFC 112" as shown in FIG. 3, according to at least one embodiment of the present disclosure, and FIG. 5 provides a cross-section side view of the tip assembly 94 without the LFC 112 as shown in FIG. 4. As shown in FIGS. 4 and 5, the tip assembly 94 includes an annular impingement plate 114 that extends radially across the downstream end of the center body 90 with respect to the longitudinal axis 92 of the fuel nozzle 70, an annular cap 116 disposed coaxially downstream from the impingement plate 114 with respect to the longitudinal axis 92 of the fuel nozzle 70, and a cooling plenum 118 that is at least partially defined between the impingement plate 110 and the cap 116.

As shown in FIGS. 4 and 5, the cap 116 includes a cool side 120 separated from a hot side 122 and a radially outer portion or shroud 124 that circumferentially surrounds the cap 116. In particular embodiments, the radially outer portion 124 extends between the impingement plate 114 and the cap 116 to at least partially define the cooling plenum 118. The cap 116 at least partially defines a cooling flow outlet 126 that extends through the cap 116 between the cold side 120 and the hot side 122. The cooling flow outlet 126 defines a flow path 128 from the cooling plenum 114 to route the compressed working fluid 18 out of the tip assembly 94. The cooling flow outlet 126 is generally concentric with a longitudinal axis 130 of the tip assembly 94. The longitudinal axis 130 of the tip assembly 94 is generally aligned with or congruent with the longitudinal axis 92 of the fuel nozzle assembly 70 when the tip assembly 94 is mounted to the fuel nozzle 70 center body 90. In particular embodiments, the cooling flow outlet 126 converges between the cold side 120 and the hot side 122 to increase an exit swirl velocity of the compressed working fluid 18 as it exits the tip assembly 94, thereby improving stabilization in recirculation zone downstream from the hot side 122 of the cap 116.

Figure 6:
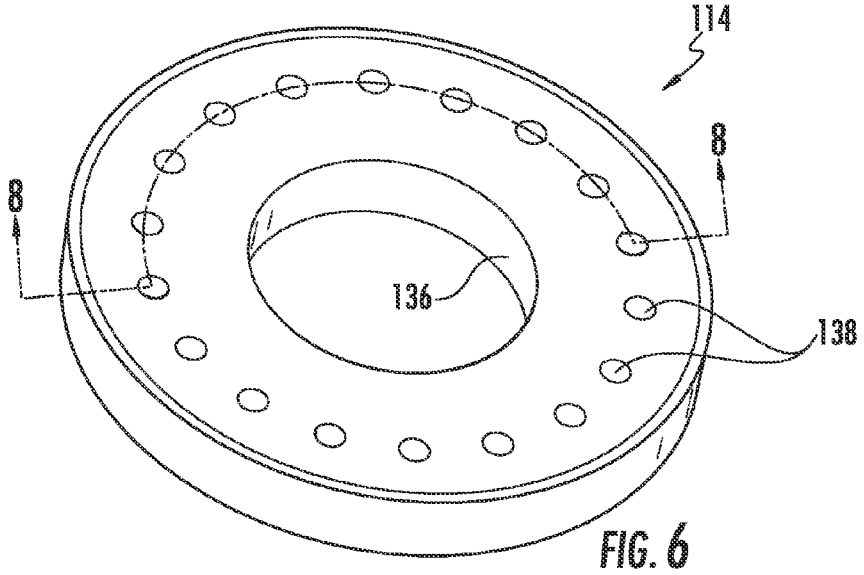
FIG. 6 provides a perspective top view of an impingement plate of the center body tip assembly as shown in FIG. 5.
Figure 7:
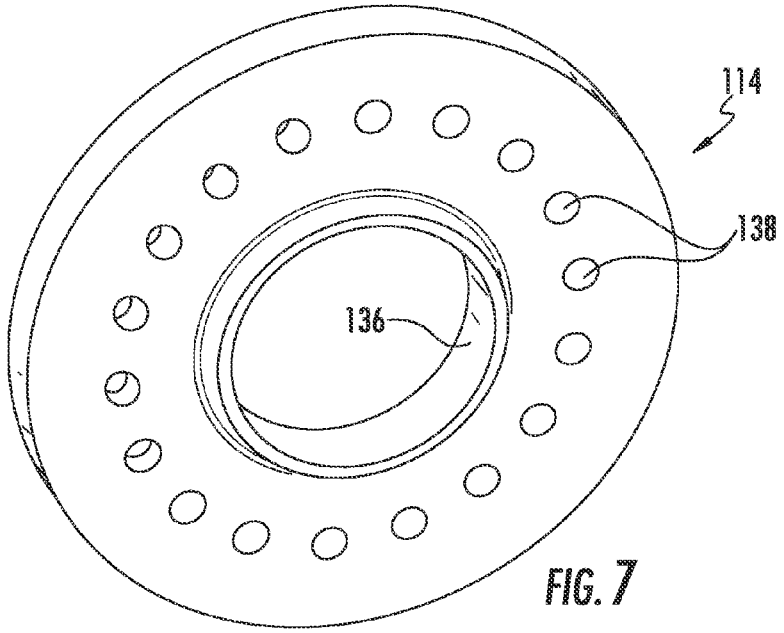
FIG. 7 provides a perspective bottom view of the impingement plate as shown in FIG. 6.

FIG. 6 provides a top perspective view of the impingement plate 114, and FIG. 7 provides a bottom perspective view of the impingement plate 114. As shown in FIG. 5, the impingement plate 114 includes an upstream surface 132 separated from a downstream surface 134. In particular embodiments, as shown in FIGS. 5 through 7 the impingement plate 114 at least partially defines an insert passage 136 that extends through the impingement plate 114 from the upstream surface 132 through the downstream surface 134. In particular embodiments, the insert passage 136 is disposed concentrically within the impingement plate 114 with respect to the longitudinal axis 130 of the tip assembly 94 and/or with respect to the longitudinal axis 92 fuel nozzle 70.

As shown in FIGS. 4 through 6, a plurality of cooling ports 138 extend through the impingement plate 114 from the upstream surface 130 through the downstream surface 132. As shown in FIGS. 4 and 5, the cooling ports 138 define a flow path 140 into the cooling plenum 118. In particular embodiments, as shown in FIGS. 4 and 5, the cooling ports 138 are in fluid communication with the cooling flow passage 108 of the fuel nozzle 70. In this manner, the compressed working fluid 18 is routed through the cooling ports 138 and into the cooling plenum 118. The compressed working fluid 18 impinges onto the cool side 120 of the cap 116 to provide at least one of impingement, conductive or convective cooling to the cap 116. The compressed working fluid 18 is then routed through the cooling flow outlet 126 towards the combustion zone 56 (FIG. 2). As a result, thermal stresses on the tip assembly 94 particularly the hot side 122 of the cap 116 may be reduced, thereby improving the overall mechanical performance of the tip assembly 94 and/or the fuel nozzle 70.

Figure 8:
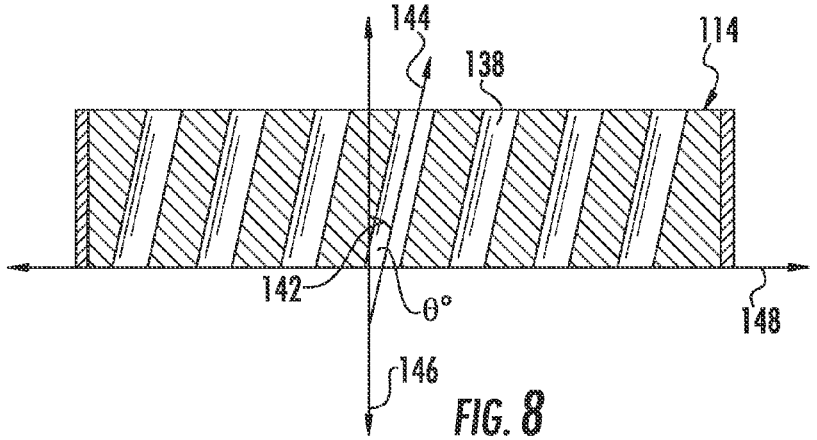
FIG. 8 provides a cross-section front view of a portion of the impingement plate taken at line 8-8 as shown in FIG. 6.

FIG. 8 provides a cross-section front view of a portion of the impingement plate as shown on FIG. 6 as taken at section 8-8, according to at least one embodiment of the present invention. In particular embodiments, as shown in FIG. 8, each or some of the cooling ports 138 are set at an angle 142 that is measured with respect to a line 144 that extends concentrically through each cooling port 138 from a longitudinal axis 146 of the impingement plate 114 within a plane that is defined between the longitudinal axis 146 and a tangential axis 148 of the impingement plate 114. Each of the cooling ports 138 may be angled in the same direction circumferentially around the impingement plate 114.

The angled cooling ports 138 impart swirl to the compressed working fluid 18 as it is routed through the cooling ports 138 and into the cooling plenum 118, thereby creating a swirling flow of the compressed working fluid 18 within the cooling plenum 118. In this manner, the compressed working fluid 18 will flow across a larger portion of the cool side 120 of the cap 116 to provide at least one of impingement, convective or conductive cooling to the cap 116 before the compressed working fluid 18 is routed through the cooling flow outlet 126 and out of the tip assembly 94. As a result, a greater portion of a cooling capacity of the compressed working fluid 18 is utilized than if the compressed working fluid 18 is allowed to flow generally axially through the cooling plenum 118 such as where impingement only cooling is utilized. Therefore, the angled cooling ports 138 substantially increase the cooling effect of the compressed working fluid 18 with respect to the cap 116 of the tip assembly 94, thereby reducing thermal stresses and improving the overall mechanical performance of the tip assembly 94 and/or the fuel nozzle 70.

Referring back to FIG. 5, in particular embodiments the tip assembly 94 further comprises an annular heat shield 150 that is concentrically disposed within the insert passage 136 of the impingement plate 114. The heat shield 150 extends at least partially through the insert passage 136 towards the cooling flow outlet 126 of the cap 116. The heat shield 150 at least partially defines the cooling plenum 118 and/or the flow path 128 from the cooling plenum 118. The heat shield 150 may be seated into the insert passage 136 by an interference fit and/or may be welded or brazed to the liquid fuel cartridge 112.

Figure 9:
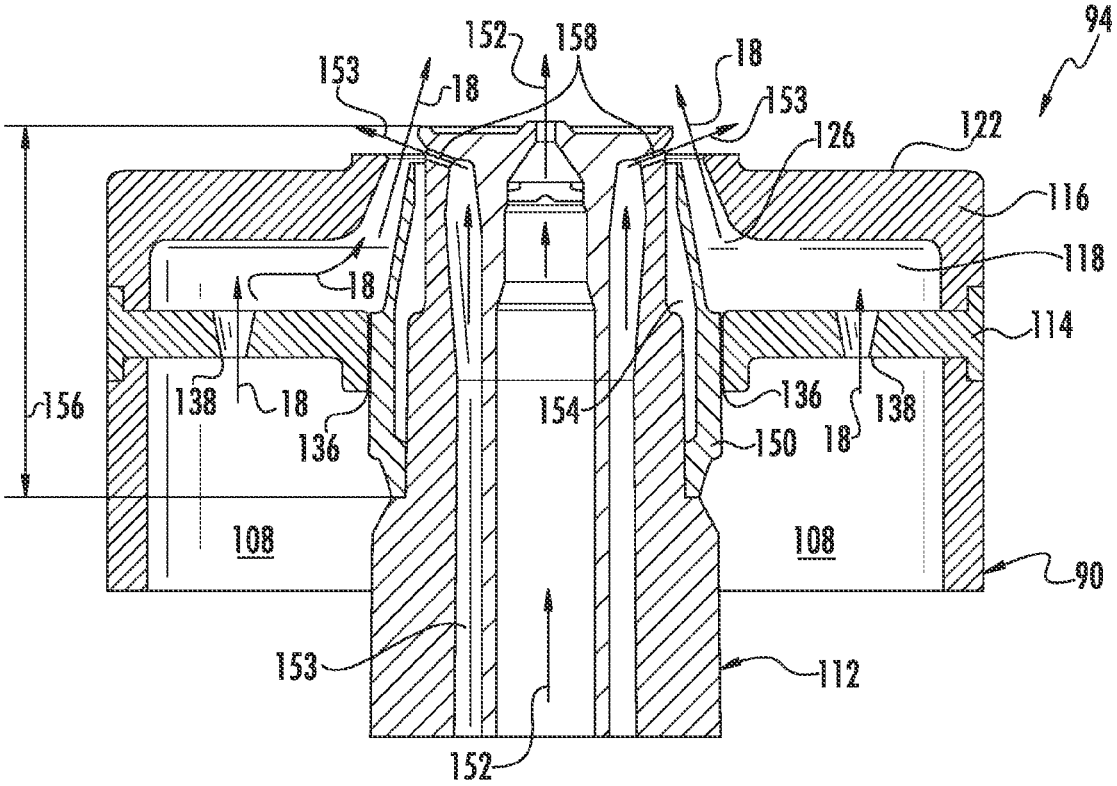
FIG. 9 provides a cross-section front view of the center body tip assembly as shown in FIG. 5, according to at least one embodiment.

FIG. 9 provides a cross-section side view of the tip assembly 94 as shown in FIG. 5, including the LFC 112 that extends at least partially through the tip assembly 94 according to at least one embodiment of the present disclosure. In particular embodiments, as shown in FIG. 3, the LFC 112 extends at least partially through the cooling flow passage 108 defined within the center body 90 of the center nozzle assembly 74. The LFC 112 is in fluid communication with the fuel supply 20 (FIG. 2) and/or the end cover 42 (FIG. 2) to provide a liquid fuel to the center nozzle assembly 74. As shown in FIG. 9, the LFC 112 extends through the impingement plate 114 and/or through the heat shield 150 towards the cooling flow outlet 126 of the cap 116. In particular embodiments, the heat shield 150 and/or the insert passage 136 of the impingement plate 114 provides structural support to the LFC 112. For example, the LFC 112 may be welded or brazed with the heat shield 150 and inserted with an interference fit within the impingement plate 114 thereby allowing for variances in thermal expansion between the various components and reducing the number of braze or weld joints within the center fuel nozzle assembly 74.

The LFC 112 generally includes a pilot liquid fuel passage 152 and a main liquid fuel passage 153. Liquid fuel and/or the compressed working fluid 18 may be routed through either or both the pilot liquid fuel passage 152 and/or the main liquid fuel passage 153 during different operation modes of the gas turbine. In one embodiment, a cartridge tip cooling plenum 154 is at least partially defined between the heat shield 150 and an injection tip portion 156 of the LFC 112. Stagnation air in the tip cooling plenum 154 provides additional thermal insulation of the liquid fuel injection tip portion 156 from heating during liquid fuel operation. The injection tip portion 156 of the LFC 112 includes a plurality of fuel injection holes 158.

The fuel injection holes 158 define a flow path through the injection tip portion 156 of the LFC 112 for injecting a liquid fuel into the combustion zone. In one embodiment, the fuel injection holes 158 define a flow path through the injection tip portion 156 of the LFC 112 for providing a portion of the compressed working fluid 18 as a cooling medium and/or as purge air to prevent ingestion of hot gases into injection tip 156 during gas only operation of the fuel nozzle 70. In another embodiment, the heat shield 150 extends downstream thru the cooling flow outlet 126 so as to direct the compressed working fluid 18 that flows out of the outlet 126 across the fuel injection holes 158 to prevent ingestion of the hot combustion gases into the fuel injection holes 158 during gas only operation of the gas turbine without having to use the compressed working fluid 18 as a purge medium for the injection tip portion 156. As a result, overheating of the fuel injection tip portion 156 during gas only operation of the fuel nozzle 70 may be prevented.

Figure 10:
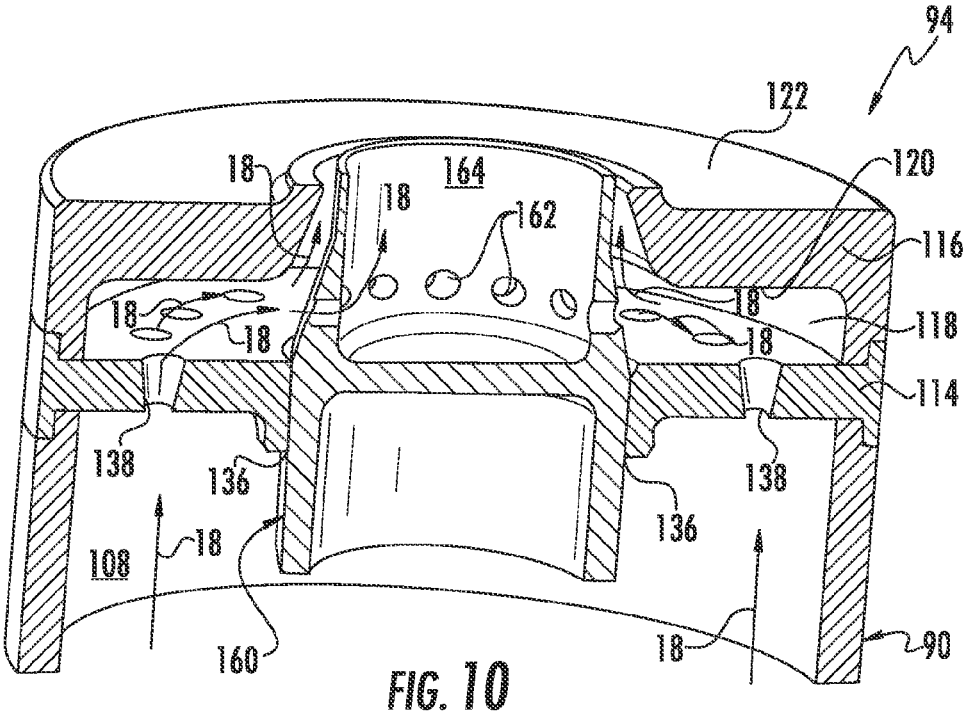
FIG. 10 provides a perspective cross section view of the center body tip assembly as shown in FIG. 5, according to another embodiment of the present invention.

In particular embodiments, the dual fuel nozzle 70 (FIG. 3) may be modified to operate as a gas only fuel nozzle. For example, as shown in FIG. 10, a purge air bypass cartridge 160 may extend through the insert passage 136 of the impingement plate 114 and through the cooling flow outlet of the cap 116 in place of the LFC 112 thru the center body 90 and upstream of the end cover 42 (FIG. 2). The purge air bypass cartridge 160 may include a plurality of cooling air passages 162 that provide for fluid communication between the cooling plenum 118 and a center cavity or cup 164 portion of the purge air bypass cartridge 160 and the cooling plenum to provide for ventilation through the cap 116 when the purge air bypass cartridge 160 is installed instead of the LFC 112.

In at least one embodiment, as shown in FIG. 9, the LFC 112 extends through the heat shield 150 of the tip assembly 94. A portion of the compressed working fluid 18 is routed from the cooling flow passage 108 through the cooling ports 138 of the impingement plate 114. The cooling ports 138 are set at an angle 142 (FIG. 8) to impart swirl to the compressed working fluid 18 flowing into the cooling plenum 118 and through the cooling flow outlet 126 in a common swirl direction or in a counter swirl direction with respect to the swirl imparted by the swirler vanes 78 (FIG. 3) disposed within the premix flow passage 76 (FIG. 3).

The swirling compressed working fluid 18 flows into the cooling plenum 118 of the tip assembly 94 and across the cool side 120 of the cap 116 to provide at least one of impingement, conductive convective cooling to the cap 116. The swirling compressed working fluid 18 is then routed through the cooling flow outlet 126 by flow path 128 (FIG. 5) to provide a generally optimized recirculation zone downstream from the hot side 122 of the cap 116. As a result, coke deposits may be reduced on the hot side 122 of the cap 116. In addition, optimization of a recirculation zone formation at the cap 116 provides robust flame stabilization at the tip assembly 94. In another embodiment, a portion of the swirling compressed working fluid 18 flowing into the cooling plenum 118 and through the cooling flow outlet 126 is used to prevent ingestion of hot combustion gases into the fuel injection holes 158 in the injection tip portion 156 of the liquid fuel cartridge during gas only operation modes.

In at least one alternate embodiment, as shown in FIG. 10, a purge air bypass cartridge 160 may be inserted through the insert passage 136 of the impingement plate 114. In this configuration, the tip assembly 94 may be utilized to provide purge air such as the compressed working fluid 18 from the cooling flow passage 108 of the center body 90 to the cooling plenum 118 of the tip assembly 94 to provide uniform cooling of the cap 116 and to provide for robust flame stabilization generally adjacent to the hot side 122 of the tip assembly 94. A portion of the swirling compressed working fluid 18 may be routed through the cooling air passages 162 of the purge air bypass cartridge 160 into the center cavity 164 of the purge air bypass cartridge 160 to provide cooling and exclusion of the hot gases from the center cavity 164 during gas only operation.

The invention as disclosed herein and as illustrated in FIGS. 3 through 10 provide various technological advantages and/or improvements over existing fuel nozzles having a tip assembly which incorporates a liquid fuel cartridge or LFC for dual fuel capability. For example, the swirling compressed working fluid remains in contact with the cool side of the cap for a longer period of time, thereby optimizing the cooling capacity of the compressed working fluid that flows across the cap. In addition, the swirling compressed working fluid exiting the cooling flow outlet provides for robust flame stabilization during gas fuel operation and provides a barrier to reduce hot gas ingestion back into the tip assembly and/or into the liquid fuel cartridge. In addition, the improved tip assembly prevents coke formation on the hot side of the cap, prevents overheating of the tip portion of the liquid fuel cartridge and improves the structural integrity of the fit between the liquid fuel cartridge and the tip assembly particularly during various thermal cycles of the combustor. Each or some of these advantages result in improved durability and performance of the fuel nozzle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A fuel nozzle for a combustor, the fuel nozzle comprising:

a burner tube component;

a center nozzle assembly concentrically disposed within the burner tube component, the center nozzle assembly having center body that at least partially defines a cooling air flow passage through the center nozzle assembly, the center body having a downstream end;

a premix flow passage defined between the burner tube component and the center nozzle assembly;

a tip assembly disposed at the downstream end of the center body, the tip assembly having an impingement plate that extends radially across the downstream end of the center body, and a radially extending cap disposed downstream from the impingement plate, the impingement plate and the cap at least partially defining a cooling plenum therebetween;

an insert passage that extends through the impingement plate;

a cooling flow outlet that extends through the cap, the cooling flow outlet being coaxially aligned with the insert passage;

a plurality of cooling ports that extend through the impingement plate to provide for fluid communication between the cooling air flow passage and the cooling plenum;

an annular heat shield concentrically disposed within the insert passage; and one of a liquid fuel cartridge or a purge air bypass cartridge concentrically disposed within the insert passage of the impingement plate and that extends through the heat shield.

2. The fuel nozzle as in claim 1, wherein the plurality of cooling ports are angled with respect to a longitudinal axis of the impingement plate within a plane defined between the longitudinal axis and a tangential axis of the impingement plate to impart swirl about the longitudinal axis to a compressed working fluid that passes therethrough.

3. The fuel nozzle as in claim 2, further comprising a plurality of swirler vanes that extend between the burner tube component and the center nozzle assembly within the premix flow passage, the swirler vanes being configured to impart swirl about a longitudinal axis of the fuel nozzle to a compressed working fluid that passes therethrough.

4. The fuel nozzle as in claim 3, wherein the plurality of cooling ports are angled to impart swirl that is opposite to the swirl imparted by the swirler vanes.

5. The fuel nozzle as in claim 1, wherein the cap includes a cool side and a hot side, the cooling flow outlet converging radially inward from the cool side towards the hot side of the cap.

6. The fuel nozzle as in claim 1, wherein the fuel nozzle includes the liquid fuel cartridge and the liquid fuel cartridge includes a fuel injection tip portion that extends through the heat shield and at least partially through the cooling flow passage of the cap.

7. The fuel nozzle as in claim 6, further comprising a cartridge tip cooling plenum that is at least partially defined between the heat shield and the fuel injection tip portion of the liquid fuel cartridge.

8. The fuel nozzle as in claim 1, wherein the fuel nozzle includes the purge air bypass cartridge, the purge air bypass cartridge including a plurality of cooling air holes that are in fluid communication with the cooling plenum.

9. A tip assembly for a fuel nozzle, comprising:

an annular impingement plate, the impingement plate at least partially defining an insert passage that extends concentrically through the impingement plate along a longitudinal axis of the tip assembly;

an annular cap disposed coaxially downstream from the impingement plate, the cap at least partially defining a cooling flow outlet, the cooling flow outlet being aligned with the insert passage, the cap having an outer portion that extends between the impingement plate and the cap, the outer portion, the cap and the impingement plate at least partially defining a cooling plenum therebetween; and a plurality of angled cooling ports extending through the impingement plate to provide fluid communication into the cooling plenum, the plurality of cooling ports being set at an angle with respect to the longitudinal axis of the impingement plate within a plane defined between the longitudinal axis and a tangential axis of the impingement plate; and one of a liquid fuel cartridge or a purge air bypass cartridge concentrically disposed within the insert passage of the impingement plate and that extends axially through the cap.

10. The tip assembly as in claim 9, wherein the cap includes a cool side and a hot side, the cooling flow outlet converging radially inward from the cool side towards the hot side of the cap.

11. The tip assembly as in claim 9, wherein the tip assembly includes the liquid fuel cartridge, the tip assembly further comprising an annular heat shield concentrically disposed within the insert passage, wherein the liquid fuel cartridge extends coaxially through the heat shield.

12. The tip assembly as in claim 11, wherein the heat shield extends through the cap.

13. The tip assembly as in claim 11, wherein the liquid fuel cartridge includes a fuel injection tip portion that extends within the heat shield and at least partially through the cooling flow passage of the cap.

14. The tip assembly as in claim 13, further comprising a cartridge tip cooling plenum that is at least partially defined between the heat shield and the fuel injection tip portion of the liquid fuel cartridge.

15. A gas turbine comprising:

a compressor at an upstream end of the gas turbine, a combustor positioned downstream from the compressor, and a turbine positioned downstream from the combustor, the combustor being in fluid communication with a fuel supply and a compressed air supply, the combustor having an end cover coupled to a casing, the casing at least partially surrounds the combustor, a fuel nozzle extends downstream from the end cover, the fuel nozzle comprising:

a burner tube component;

a center nozzle assembly concentrically disposed within the burner tube component, the center nozzle assembly having an annular center body that at least partially defines a cooling air flow passage through the center nozzle assembly, the center body having a downstream end;

a premix flow passage defined between the burner tube component and the center body assembly;

a tip assembly disposed at the downstream end of the center body, the tip assembly having an impingement plate that extends radially across the downstream end of the center body and a radially extending cap disposed coaxially downstream from the impingement plate, the impingement plate and the cap at least partially defining a cooling plenum therebetween, the impingement plate at least partially defining an insert passage and the cap at least partially defining a cooling flow outlet that is aligned with the insert passage;

a plurality of angled cooling ports that extend through the impingement plate to provide for fluid communication between the cooling air flow passage and the cooling plenum; and one of a liquid fuel cartridge or a purge air bypass cartridge concentrically disposed within the insert passage of the impingement plate and that extends axially through the cap.

16. The gas turbine as in claim 15, wherein the plurality of cooling ports of the impingement plate are arranged in an annular array around the insert passage.

17. The gas turbine as in claim 15, wherein the plurality of cooling ports of the impingement plate are angled with respect to a longitudinal axis of the impingement plate within a plane defined between the longitudinal axis and a tangential axis of the impingement plate to impart swirl about the longitudinal axis to a cooling medium that passes therethrough.

18. The gas turbine as in claim 15, wherein the tip assembly further comprises an annular heat shield concentrically disposed within the insert passage and the liquid fuel cartridge, wherein the liquid fuel cartridge that extends through the heat shield, the heat shield and the liquid fuel cartridge at least partially defining a cartridge tip cooling plenum therebetween.

* * * * *